US008550185B2

(12) United States Patent
Johnson et al.

(10) Patent No.: US 8,550,185 B2
(45) Date of Patent: Oct. 8, 2013

(54) STOCHASTIC BIT NOISE

(75) Inventors: Ashley Bernard Johnson, Milton (GB); Michael Charles Sheppard, Hadstock (GB); Geoff Downton, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/276,430

(22) Filed: Oct. 19, 2011

(65) Prior Publication Data

US 2012/0090897 A1 Apr. 19, 2012

Related U.S. Application Data

(60) Division of application No. 12/116,380, filed on May 7, 2008, now Pat. No. 8,066,085, which is a continuation-in-part of application No. 11/839,381, filed on Aug. 15, 2007.

(51) Int. Cl.
*E21B 7/04* (2006.01)

(52) U.S. Cl.
USPC ..... 175/61; 175/73

(58) Field of Classification Search
USPC ..... 175/24, 26, 55, 56, 263, 266, 61, 175/67, 63, 73
See application file for complete search history.

(56) References Cited

U.S. PATENT DOCUMENTS

| | | | |
|---|---|---|---|
| 1,156,147 | A | 10/1915 | Karns |
| 1,638,337 | A | 8/1927 | Hutton |
| 1,667,155 | A | 4/1928 | Higdon |
| 2,010,789 | A | 8/1935 | Roesel |
| 2,016,042 | A | 10/1935 | Lewis |
| 2,238,377 | A | 4/1941 | Strang |
| 2,670,046 | A | 2/1954 | Kinzbach |
| 3,224,513 | A | 12/1965 | Weeden, Jr. |
| 3,285,349 | A | 11/1966 | Brandon |
| 4,190,123 | A | 2/1980 | Roddy |
| 4,211,292 | A | 7/1980 | Evans |
| 4,319,649 | A | 3/1982 | Jeter |
| 4,394,193 | A | 7/1983 | Gfrerer |

(Continued)

FOREIGN PATENT DOCUMENTS

| | | | |
|---|---|---|---|
| BE | 1012545 | A3 | 12/2000 |
| EP | 0530045 | B1 | 3/1993 |

(Continued)

OTHER PUBLICATIONS

Office Action of Chinese Application No. 200880111732.0 dated Apr. 12, 2013: pp. 1-3.

(Continued)

*Primary Examiner* — David Bagnell
*Assistant Examiner* — James Sayre

(57) ABSTRACT

A drill bit direction system and method is disclosed that modifies or biases the stochastic movement of the drill bit and/or stochastic interactions between the drill bit and an inner-wall of a borehole being drilled by a drilling system to change the direction of drilling of the drilling system. The direction of the drill bit is monitored to determine if the direction happens to align in some way with a preferred direction. If the direction isn't close enough to a preferred direction, a biasing mechanism modifies the stochastic movement in an attempt to modify the direction closer to the preferred direction. Any of a number of biasing mechanisms can be used. Some embodiments can resort to conventional steering mechanisms to supplement the biasing mechanism.

17 Claims, 7 Drawing Sheets

(56) References Cited

U.S. PATENT DOCUMENTS

| | | | |
|---|---|---|---|
| 4,690,229 | A | 9/1987 | Raney |
| 4,739,843 | A | 4/1988 | Burton |
| 4,775,017 | A | 10/1988 | Forrest et al. |
| 4,807,708 | A | 2/1989 | Forrest et al. |
| 4,842,083 | A | 6/1989 | Raney |
| 4,856,601 | A | 8/1989 | Raney |
| 5,010,789 | A | 4/1991 | Brett et al. |
| 5,042,596 | A | 8/1991 | Brett et al. |
| 5,090,492 | A | 2/1992 | Keith |
| 5,113,953 | A | 5/1992 | Noble |
| 5,159,577 | A | 10/1992 | Twist |
| 5,163,524 | A | 11/1992 | Newton, Jr. et al. |
| 5,213,168 | A | 5/1993 | Warren et al. |
| 5,265,682 | A | 11/1993 | Russell et al. |
| 5,339,910 | A | 8/1994 | Mueller |
| 5,341,886 | A | 8/1994 | Patton |
| 5,343,964 | A | 9/1994 | Leroy |
| 5,361,859 | A | 11/1994 | Tibbitts |
| 5,423,389 | A | 6/1995 | Warren et al. |
| 5,490,569 | A | 2/1996 | Brotherton et al. |
| 5,520,255 | A | 5/1996 | Barr et al. |
| 5,553,678 | A | 9/1996 | Barr et al. |
| 5,553,679 | A | 9/1996 | Thorp |
| 5,560,440 | A | 10/1996 | Tibbitts |
| 5,582,259 | A | 12/1996 | Barr |
| 5,603,385 | A | 2/1997 | Colebrook |
| 5,641,421 | A | 6/1997 | Manov et al. |
| 5,649,604 | A | 7/1997 | Fuller et al. |
| 5,651,421 | A | 7/1997 | Newton et al. |
| 5,673,763 | A | 10/1997 | Thorp |
| 5,685,379 | A | 11/1997 | Barr et al. |
| 5,695,015 | A | 12/1997 | Barr et al. |
| 5,697,461 | A | 12/1997 | Newton et al. |
| 5,706,905 | A | 1/1998 | Barr |
| 5,778,992 | A | 7/1998 | Fuller |
| 5,803,185 | A | 9/1998 | Barr et al. |
| 5,803,196 | A | 9/1998 | Fielder |
| 5,836,406 | A | 11/1998 | Schuh |
| 5,971,085 | A | 10/1999 | Colebrook |
| 5,979,577 | A | 11/1999 | Fielder |
| 6,089,332 | A | 7/2000 | Barr et al. |
| 6,092,610 | A | 7/2000 | Kosmala et al. |
| 6,142,250 | A | 11/2000 | Griffin et al. |
| 6,158,529 | A | 12/2000 | Dorel |
| 6,244,361 | B1 | 6/2001 | Comeau et al. |
| 6,257,356 | B1 | 7/2001 | Wassell |
| 6,290,007 | B2 | 9/2001 | Beuershausen et al. |
| 6,360,831 | B1 | 3/2002 | Akesson et al. |
| 6,364,034 | B1 | 4/2002 | Schoeffler |
| 6,394,193 | B1 | 5/2002 | Askew |
| 6,427,792 | B1 | 8/2002 | Roberts et al. |
| 6,601,658 | B1 | 8/2003 | Downton |
| 6,604,658 | B1 | 8/2003 | Young et al. |
| 6,629,476 | B2 | 10/2003 | Fielder et al. |
| 6,904,984 | B1 | 6/2005 | Estes et al. |
| 6,971,459 | B2 | 12/2005 | Raney |
| 7,090,037 | B2 | 8/2006 | Best |
| 7,201,237 | B2 | 4/2007 | Raney |
| 7,287,604 | B2 | 10/2007 | Aronstam et al. |
| 7,308,955 | B2 | 12/2007 | Barton et al. |
| 7,757,784 | B2 | 7/2010 | Fincher et al. |
| 7,762,356 | B2 | 7/2010 | Turner et al. |
| 7,845,430 | B2 | 12/2010 | Johnson et al. |
| 7,971,661 | B2 | 7/2011 | Johnson et al. |
| 7,971,662 | B2 | 7/2011 | Beuershausen |
| 8,066,085 | B2 | 11/2011 | Johnson et al. |
| 8,087,479 | B2 | 1/2012 | Kulkarni et al. |
| 2001/0052428 | A1 | 12/2001 | Larronde et al. |
| 2002/0011359 | A1 | 1/2002 | Webb et al. |
| 2002/0020565 | A1 | 2/2002 | Hart et al. |
| 2002/0053470 | A1 | 5/2002 | Noe et al. |
| 2002/0088649 | A1 | 7/2002 | Morris, Sr. et al. |
| 2003/0056991 | A1 | 3/2003 | Hahn et al. |
| 2004/0099444 | A1 | 5/2004 | Chen et al. |
| 2004/0216921 | A1 | 11/2004 | Krueger |
| 2005/0020565 | A1 | 1/2005 | Jones et al. |
| 2005/0056463 | A1 | 3/2005 | Aronstam et al. |
| 2005/0236187 | A1 | 10/2005 | Chen et al. |
| 2005/0269082 | A1 | 12/2005 | Baron et al. |
| 2006/0157277 | A1 | 7/2006 | Bittar et al. |
| 2006/0196697 | A1 | 9/2006 | Raney |
| 2006/0237234 | A1 | 10/2006 | Dennis et al. |
| 2006/0249287 | A1 | 11/2006 | Downton et al. |
| 2007/0007000 | A1 | 1/2007 | Dewey et al. |
| 2007/0205022 | A1 | 9/2007 | Treviranus et al. |
| 2007/0272445 | A1 | 11/2007 | Cariveau et al. |
| 2008/0000693 | A1 | 1/2008 | Hutton |
| 2008/0115974 | A1 | 5/2008 | Johnson et al. |
| 2009/0044977 | A1 | 2/2009 | Johnson et al. |
| 2009/0044979 | A1 | 2/2009 | Johnson et al. |
| 2009/0044980 | A1 | 2/2009 | Sheppard et al. |
| 2009/0044981 | A1 | 2/2009 | Sheppard et al. |
| 2009/0065262 | A1 | 3/2009 | Downton et al. |
| 2009/0188720 | A1 | 7/2009 | Johnson et al. |
| 2009/0194334 | A1 | 8/2009 | Johnson et al. |
| 2010/0038141 | A1 | 2/2010 | Johnson et al. |
| 2012/0018224 | A1 | 1/2012 | Johnson et al. |
| 2012/0080235 | A1 | 4/2012 | Sheppard et al. |

FOREIGN PATENT DOCUMENTS

| | | | |
|---|---|---|---|
| EP | 0707131 | B1 | 4/1996 |
| EP | 1227214 | B1 | 7/2002 |
| GB | 2257182 | A | 1/1993 |
| GB | 2285651 | A | 7/1995 |
| GB | 2304759 | A | 3/1997 |
| GB | 2343470 | A | 5/2000 |
| GB | 2355744 | A | 5/2001 |
| GB | 2367626 | A | 4/2002 |
| GB | 2425790 | A | 5/2005 |
| GB | 2408526 | A | 6/2005 |
| GB | 2423102 | A | 8/2006 |
| GB | 2423546 | A | 8/2006 |
| GB | 2439661 | A | 1/2008 |
| RU | 2006560 | C1 | 1/1994 |
| RU | 2029047 | C1 | 2/1995 |
| RU | 2072419 | C1 | 1/1997 |
| RU | 2100559 | C1 | 12/1997 |
| RU | 2239042 | C2 | 10/2004 |
| RU | 2006100565 | A | 7/2007 |
| WO | 9619635 | A1 | 6/1996 |
| WO | 9747848 | A1 | 12/1997 |
| WO | 9815710 | A1 | 4/1998 |
| WO | 9928587 | A1 | 6/1999 |
| WO | 0121927 | A2 | 3/2001 |
| WO | 0236924 | A2 | 5/2002 |
| WO | 03004824 | A1 | 1/2003 |
| WO | 03052237 | A1 | 6/2003 |
| WO | 03097989 | A1 | 11/2003 |
| WO | 2004104360 | A2 | 11/2004 |
| WO | 2004113664 | A1 | 12/2004 |
| WO | 2006012186 | A1 | 2/2006 |
| WO | 2007012858 | A1 | 2/2007 |
| WO | 2007036722 | | 4/2007 |

OTHER PUBLICATIONS

Dictionary definition of "geostationary" accessed Feb. 24, 2012: p. 1, <http://www.thefreedictionary.com/p/geostationary>.

STOCHASTIC BIT NOISE

This application is a divisional application of and claims priority to U.S. patent application Ser. No. 12/116,380, entitled "STOCHASTIC BIT NOISE CONTROL" (United States Patent Application Publication Number 2009/0044978), which application claimed the benefit of and is a continuation-in-part application of U.S. patent application Ser. No. 11/839,381 filed on Aug. 15, 2007, entitled "SYSTEM AND METHOD FOR CONTROLLING A DRILLING SYSTEM FOR DRILLING A BOREHOLE IN AN EARTH FORMATION." Both applications (U.S. patent application Ser. Nos. 12/116,380 and 11/839,381) are hereby expressly incorporated by reference in their entirety for all purposes.

BACKGROUND

This disclosure relates in general to drilling a borehole and, but not by way of limitation, to controlling direction of drilling for the borehole.

In many industries, it is often desirable to directionally drill a borehole through an earth formation or core a hole in subsurface formations in order that the borehole and/or coring may circumvent and/or pass through deposits and/or reservoirs in the formation to reach a predefined objective in the formation and/or the like. When drilling or coring holes in sub-surface formations, it is sometimes desirable to be able to vary and control the direction of drilling, for example to direct the borehole towards a desired target, or control the direction horizontally within an area containing hydrocarbons once the target has been reached. It may also be desirable to correct for deviations from the desired direction when drilling a straight hole, or to control the direction of the hole to avoid obstacles.

In the hydrocarbon industry for example, a borehole may be drilled so as to intercept a particular subterranean-formation at a particular location. In some drilling processes, to drill the desired borehole, a drilling trajectory through the earth formation may be pre-planned and the drilling system may be controlled to conform to the trajectory. In other processes, or in combination with the previous process, an objective for the borehole may be determined and the progress of the borehole being drilled in the earth formation may be monitored during the drilling process and steps may be taken to ensure the borehole attains the target objective. Furthermore, operation of the drill system may be controlled to provide for economic drilling, which may comprise drilling so as to bore through the earth formation as quickly as possible, drilling so as to reduce bit wear, drilling so as to achieve optimal drilling through the earth formation and optimal bit wear and/or the like.

One aspect of drilling is called "directional drilling." Directional drilling is the intentional deviation of the borehole/wellbore from the path it would naturally take. In other words, directional drilling is the steering of the drill string so that it travels in a desired direction.

Directional drilling is advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well.

A directional drilling system may also be used in vertical drilling operation as well. Often the drill bit will veer off of a planned drilling trajectory because of the unpredictable nature of the formations being penetrated or the varying forces that the drill bit experiences. When such a deviation occurs, a directional drilling system may be used to put the drill bit back on course.

The monitoring process for directional drilling of the borehole may include determining the location of the drill bit in the earth formation, determining an orientation of the drill bit in the earth formation, determining a weight-on-bit of the drilling system, determining a speed of drilling through the earth formation, determining properties of the earth formation being drilled, determining properties of a subterranean formation surrounding the drill bit, looking forward to ascertain properties of formations ahead of the drill bit, seismic analysis of the earth formation, determining properties of reservoirs etc. proximal to the drill bit, measuring pressure, temperature and/or the like in the borehole and/or surrounding the borehole and/or the like. In any process for directional drilling of a borehole, whether following a pre-planned trajectory, monitoring the drilling process and/or the drilling conditions and/or the like, it is necessary to be able to steer the drilling system.

Forces which act on the drill bit during a drilling operation include gravity, torque developed by the bit, the end load applied to the bit, and the bending moment from the drill assembly. These forces together with the type of strata being drilled and the inclination of the strata to the bore hole may create a complex interactive system of forces during the drilling process.

The drilling system may comprise a "rotary drilling" system in which a downhole assembly, including a drill bit, is connected to a drill-string that may be driven/rotated from the drilling platform. In a rotary drilling system directional drilling of the borehole may be provided by varying factors such as weight-on-bit, the rotation speed, etc.

With regards to rotary drilling, known methods of directional drilling include the use of a rotary steerable system (RSS). In an RSS, the drill string is rotated from the surface, and downhole devices cause the drill bit to drill in the desired direction. Rotating the drill string greatly reduces the occurrences of the drill string getting hung up or stuck during drilling.

Rotary steerable drilling systems for drilling deviated boreholes into the earth may be generally classified as either "point-the-bit" systems or "push-the-bit" systems. In the point-the-bit system, the axis of rotation of the drill bit is deviated from the local axis of the bottomhole assembly ("BHA") in the general direction of the new hole. The hole is propagated in accordance with the customary three-point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the bottomhole assembly close to the lower stabilizer or a flexure of the drill bit drive shaft distributed between the upper and lower stabilizer.

Pointing the bit may comprise using a downhole motor to rotate the drill bit, the motor and drill bit being mounted upon a drill string that includes an angled bend. In such a system, the drill bit may be coupled to the motor by a hinge-type or tilted mechanism/joint, a bent sub or the like, wherein the drill bit may be inclined relative to the motor. When variation of the direction of drilling is required, the rotation of the drill-string may be stopped and the bit may be positioned in the borehole, using the downhole motor, in the required direction and rotation of the drill bit may start the drilling in the desired direction. In such an arrangement, the direction of drilling is dependent upon the angular position of the drill string.

In its idealized form, in a pointing the bit system, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953 all herein incorporated by reference.

Push the bit systems and methods make use of application of force against the borehole wall to bend the drill-string and/or force the drill bit to drill in a preferred direction. In a push-the-bit rotary steerable system, the requisite non-collinear condition is achieved by causing a mechanism to apply a force or create displacement in a direction that is preferentially orientated with respect to the direction of hole propagation. There are many ways in which this may be achieved, including non-rotating (with respect to the hole), displacement based approaches and eccentric actuators that apply force to the drill bit in the desired steering direction. Again, steering is achieved by creating non co-linearity between the drill bit and at least two other touch points. In its idealized form the drill bit is required to cut side ways in order to generate a curved hole. Examples of push-the-bit type rotary steerable systems, and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; 5,971,085 all herein incorporated by reference.

Known forms of RSS are provided with a "counter rotating" mechanism which rotates in the opposite direction of the drill string rotation. Typically, the counter rotation occurs at the same speed as the drill string rotation so that the counter rotating section maintains the same angular position relative to the inside of the borehole. Because the counter rotating section does not rotate with respect to the borehole, it is often called "geostationary" by those skilled in the art. In this disclosure, no distinction is made between the terms "counter rotating" and "geo-stationary."

A push-the-bit system typically uses either an internal or an external counter-rotation stabilizer. The counter-rotation stabilizer remains at a fixed angle (or geo-stationary) with respect to the borehole wall. When the borehole is to be deviated, an actuator presses a pad against the borehole wall in the opposite direction from the desired deviation. The result is that the drill bit is pushed in the desired direction.

The force generated by the actuators/pads is balanced by the force to bend the bottomhole assembly, and the force is reacted through the actuators/pads on the opposite side of the bottomhole assembly and the reaction force acts on the cutters of the drill bit, thus steering the hole. In some situations, the force from the pads/actuators may be large enough to erode the formation where the system is applied.

For example, the Schlumberger™ Powerdrive™ system uses three pads arranged around a section of the bottomhole assembly to be synchronously deployed from the bottomhole assembly to push the bit in a direction and steer the borehole being drilled. In the system, the pads are mounted close, in a range of 1-4 ft behind the bit and are powered/actuated by a stream of mud taken from the circulation fluid. In other systems, the weight-on-bit provided by the drilling system or a wedge or the like may be used to orient the drilling system in the borehole.

While system and methods for applying a force against the borehole wall and using reaction forces to push the drill bit in a certain direction or displacement of the bit to drill in a desired direction may be used with drilling systems including a rotary drilling system, the systems and methods may have disadvantages. For example such systems and methods may require application of large forces on the borehole wall to bend the drill-string and/or orient the drill bit in the borehole; such forces may be of the order of 5 kN or more, that may require large/complicated downhole motors or the like to be generated. Additionally, many systems and methods may use repeatedly thrusting of pads/actuator outwards into the borehole wall as the bottomhole assembly rotates to generate the reaction forces to push the drill bit, which may require complex/expensive/high maintenance synchronizing systems, complex control systems and/or the like.

The drill bit is known to "dance" or clatter around in a borehole in an unpredictable or even random manner. This stochastic movement is generally non-deterministic in that a current state does not fully determine its next state. Point-the-bit and push-the-bit techniques are used to force a drill bit into a particular direction and overcome the tendency for the drill bit to clatter. These techniques ignore the stochastic dance a drill bit is likely to make in the absence of directed force.

SUMMARY

In an embodiment, the present disclosure provides for a drill bit direction system that modifies or biases stochastic or natural movement of the drill bit and/or stochastic reaction forces between the drill bit and/or gauge pads and an inner-wall of the borehole being drilled to change a direction of drilling. The change of direction of drilling may in certain aspects be achieved with less effort, less complex surface/downhole machinery and/or more economically than with conventional steering mechanisms. The direction of the drill bit relative to the earth (or some other fixed point) is monitored to determine if the direction happens to align in some way with a preferred direction. If the direction isn't close enough to a preferred direction, a biasing mechanism emphasizes components of radial motion to move the direction closer to the preferred direction. Any of a number of biasing mechanisms can be used. Some embodiments can resort to conventional steering mechanisms to supplement or as an alternative to the biasing mechanism.

In another embodiment, a method for biasing erratic motion of a drill bit to directionally cause the drill bit to drill in a predetermined direction relative to the earth is disclosed. In one step, a direction of the drill bit relative to the earth is determined The direction is compared with the predetermined direction. A biasing mechanism is oriented to emphasize components of radial motion of the drill bit in the predetermined direction. The biasing mechanism is activated when the comparing step determines the direction is not adequately aligned with the predetermined direction.

In yet another embodiment, a drill bit direction system for biasing erratic motion of a drill bit to directionally cause a drill bit to drill in a predetermined direction relative to the earth is disclosed. The drill bit direction system includes a biasing mechanism, a direction sensor and a controller. The biasing mechanism emphasizes components of radial motion of the drill bit in the predetermined direction of the drill bit relative to the earth. The direction sensor determines a direction of the drill bit downhole. The controller compares a predetermined direction with the direction. The biasing mechanism is activated when the direction deviates from the predetermined direction.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with the appended figures.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability or configuration of the disclosure. Rather, the ensuing description of the preferred exemplary embodiment(s) will provide those skilled in the art with an enabling description for implementing a preferred exemplary embodiment. It being understood that various changes may be made in the function and arrangement of elements without departing from the spirit and scope as set forth in the appended claims.

Figure 1:
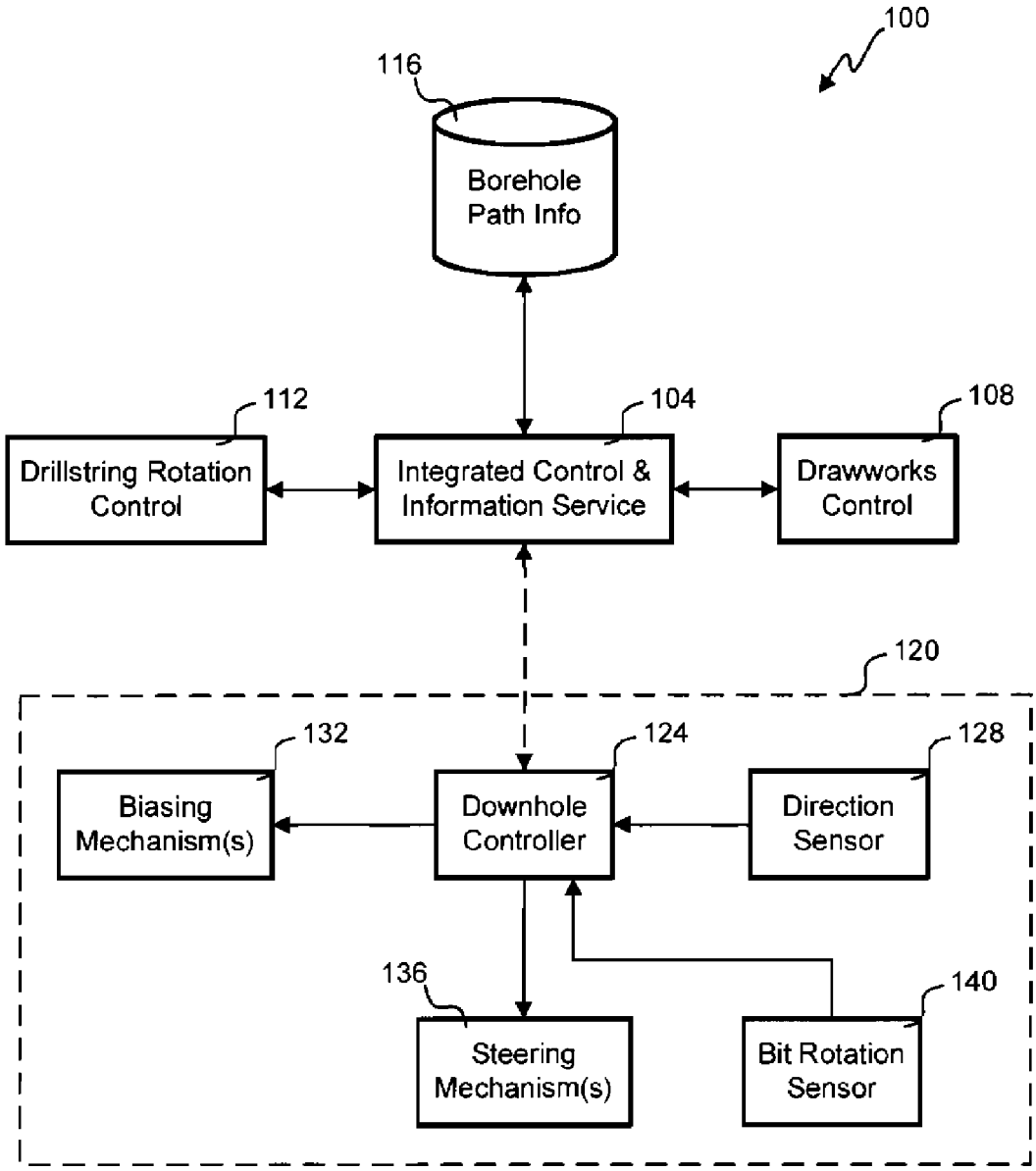
FIG. 1 depicts a block diagram of an embodiment of a drill bit direction system.

Referring first to FIG. 1, a block diagram of an embodiment of a drill bit direction system 100 is shown. An integrated control and information service (ICIS) 104 is located above ground to manage the drillstring rotation control block 112 and the drawworks control block 108. Additionally, the ICIS 104 generally guides the direction of drilling in the earth formation. Information is communicated downhole to a bottomhole assembly (BHA) 120 such as a desired orientation or direction to achieve for the drill bit and possibly selection of various biasing and steering mechanisms 132, 136 to use. The direction is defined relative to any fixed point such as the earth. The information may additionally provide control information for the BHA 120 and any biasing and steering mechanisms 132, 136.

The ICIS 104 manages the drillstring rotation control block 112 and the drawworks control block 108. The phase, torque and speed of rotation of the drillstring is monitored and managed by the drillstring control block 112. Information from the BHA 120 can be analyzed by the ICIS 104 as feedback on how the management is being performed by the drillstring control block 112. Various operations during drilling use the drawworks control block 108, for example, removal of the drillstring. The ICIS 104 manages operation of the drawworks control block 108 during these operations.

The BHA 120 includes a downhole controller 124, an orientation or direction sensor 128, a bit rotation sensor 140, one or more biasing mechanism 132, and one or more steering mechanisms 136. A typical BHA may have more control systems, which are not shown in FIG. 1. Information is communicated to the BHA 120 from the surface to indicate a preferred direction of the drill bit. Additionally, use of biasing and steering mechanisms 132, 136 can be generally controlled by the ICIS 104, but the downhole controller 124 controls real-time operation of the biasing and steering mechanisms 132, 136 with information gathered from the direction and bit rotation sensors 128, 140.

Information is communicated from the BHA 120 back to the ICIS 104 at the surface. The direction of the drill bit observed may be periodically communicated along with use of various biasing and steering mechanisms 132, 136. A borehole path information database 116 stores the information gathered downhole to know how the borehole navigates through the formation. The ICIS 104 can recalculate the best orientation or direction to use for the drill bit and communicate that to the BHA 120 to override the prior instructions. Additionally, the effectiveness of the various biasing and steering mechanisms 132, 136 can be analyzed with other information gathered on the formation to provide guidance downhole on how to best use the available biasing and steering mechanisms 132, 136 to achieve the geometry of the borehole desired for a particular drill site.

The direction sensor 128 can determine the current direction of the drill bit with respect to a particular frame of reference in three dimensions (i.e., relative to the earth or some other fixed point). Various techniques can be used to determine the current direction, for example, an inertially or roll-stabilized platform with gyros can be compared to references on the drill bit, accelerometers could be used to track direction and/or magnetometers could measure direction relative to the earth's magnetic field. Measurements could be noisy, but a filter could be used to average out the noise from measurements.

The bit rotation sensor 140 allows monitoring the phase of rotation for the drill bit. The downhole controller 124 takes the sensor information to allow synchronized control of the biasing mechanism(s) 132. With knowledge of the phase, the biasing can be performed every rotation cycle or any integer fraction of the cycles (e.g., every other rotation, every third rotation, every fourth rotation, every tenth rotation, etc.). Other embodiments do not use a bit rotation sensor 140 or synchronized manipulation of the biasing mechanism(s) 132.

There are various steering mechanisms 136 that persistently enforce drill bit movement. Steering mechanisms 136 do not intentionally take advantage of the stochastic movement of the drill bit that naturally occurs. A given site may use one or more of these steering mechanisms 136 to create a borehole that changes direction as desired through the formation. Different types of steering mechanisms 136 include bent arms, lever arms synchronized with rotation, universal joints, and geostationary mechanisms that exert force in a particular direction. These steering mechanisms can predictably direct the drill bit, but do not take advantage stochastic movement of the drill bit that could be in the correct direction anyway. Other embodiments may forgo steering mechanisms 136 completely by reliance on biasing mechanisms 132 for directional drilling.

A biasing mechanism 132 can be used before resort to a steering mechanism 136. The biasing mechanism 132 selects or emphasizes those components of the radial motion of the drill bit in a chosen direction. Directional control is achieved by holding the orientation of the biasing mechanism 132 broadly fixed in the chosen direction. Some embodiments may only have one or more biasing mechanisms 132 downhole without any steering mechanisms 136. Biasing mechanisms 132 take advantage of the tendency for the drill bit to move around in the bore hole by only activating when the stochastic movement goes in the wrong direction. For example, gage pads or cutters can be moved, a gage ring can exert pressure and/or jetting can be used in various embodiments as the biasing mechanism 132. Any asymmetry that can be manipulated is usable as a biasing mechanism 132. In some cases, the drill bit is designed and manufactured so as to exert a side force in a particular azimuthal direction relative to the drill bit. The biasing mechanism 132 is activated to bias the side force. Such a side force rotates with the drill bit to emphasize cutting in the chosen direction. The biasing mechanism 132 can be synchronized to activate and deactivate with rotation of the drill bit.

The downhole controller 124 uses the information sent from the ICIS 104 along with the direction and bit rotation sensors 128, 140 to actively manage the use of biasing and steering mechanisms 132, 136. The desired direction of the drill bit along with guidelines for using various biasing and steering mechanisms 132, 136 is communicated from the ICIS 104. The downhole controller 124 can use fuzzy logic, neural algorithms, expert system algorithms to decide how and when to influence the drill bit direction in various embodiments. Generally, the speed of communication between the BHA 120 and the ICIS 104 does not allow real-time control from the surface in this embodiment, but other embodiments could allow for surface control in real-time. The stochastic direction of the drill bit can be adaptively used in a less rigid manner. For example, if a future turn in the borehole is desired and the drill bit is making the turn prematurely, the turn can be accepted and the future plan revised.

Figure 2A:
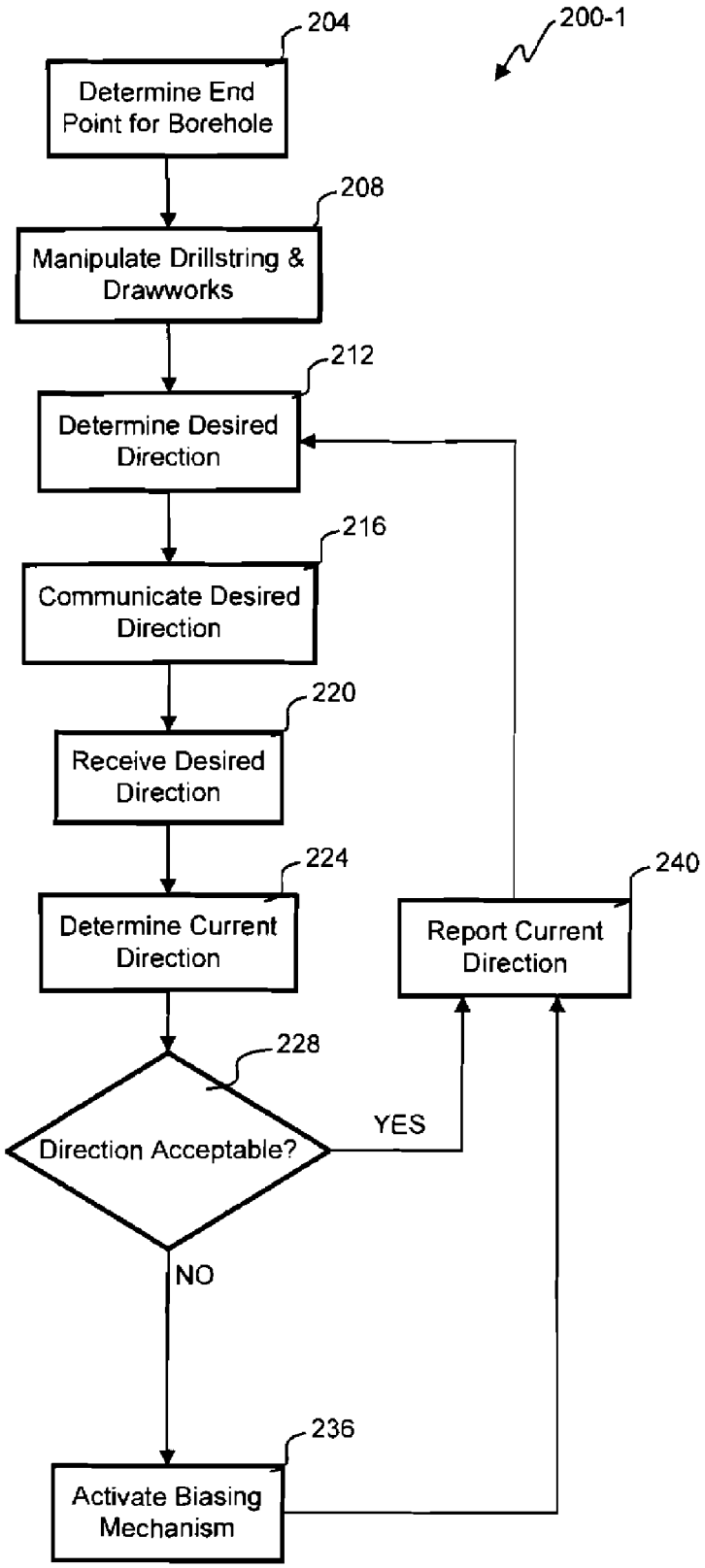
FIGS. 2A through 2C illustrate flowcharts of embodiments of a process for controlling drill bit direction.

With reference to FIG. 2A, a flowchart of an embodiment of a process 200-1 for controlling drill bit direction is shown. This embodiment only uses a single biasing mechanism 136 to control the direction of the drill bit. The depicted portion of the process beings in block 204 where an analysis of the formation and end point is performed to plan the borehole geometry. The ICIS 104 manipulates the drillstring, drawworks and other systems in block 208 to create the borehole according to the plan. A desired direction of the drill bit is determined in block 212 and communicated to the downhole controller 124 in block 216. The desired direction could be a single goal or a range of acceptable directions.

The desired direction along with any biasing selection criteria is received by the downhole controller 124 in block 220. The current pointing of the drill bit is determined by the direction sensor 128 in block 224. It is determined in block 228 if the direction is acceptable based upon the instructions from ICIS 104. This embodiment allows some flexibility in the direction and re-determines the plan based upon the stochastic movement allowed to occur. An acceptable direction is one that allows achieving the end point with the drill bit if the plan were revised. A certain plan may have predetermined deviations or ranges of direction that are acceptable, but still avoid parts of the formation that are not desired to pass through.

Where the direction is not acceptable, processing goes from block 228 to block 236 where the biasing mechanism 132 is activated. The biasing mechanism 132 could be activated once or for a period of time. Alternatively, the biasing mechanism 132 could be activated periodically in synchronization with the rotation of the drill bit. The biasing mechanism 132 selects or emphasizes those components of the radial motion of the drill bit that occur in the desired direction (s).

Where the direction is acceptable as determined in block 228, processing continues to block 240. The biasing mechanism 132 achieves directional control by holding the direction in the desired direction(s). Where un-needed because the erratic motion of the drill bit is already in the desired direction (s), the biasing mechanism 132 is not activated. In block 240, the current direction is communicated by the downhole controller 124 to the ICIS 104. After reporting, processing loops back to block 212 for further management of the direction based upon any new instruction from the surface.

Figure 2B:
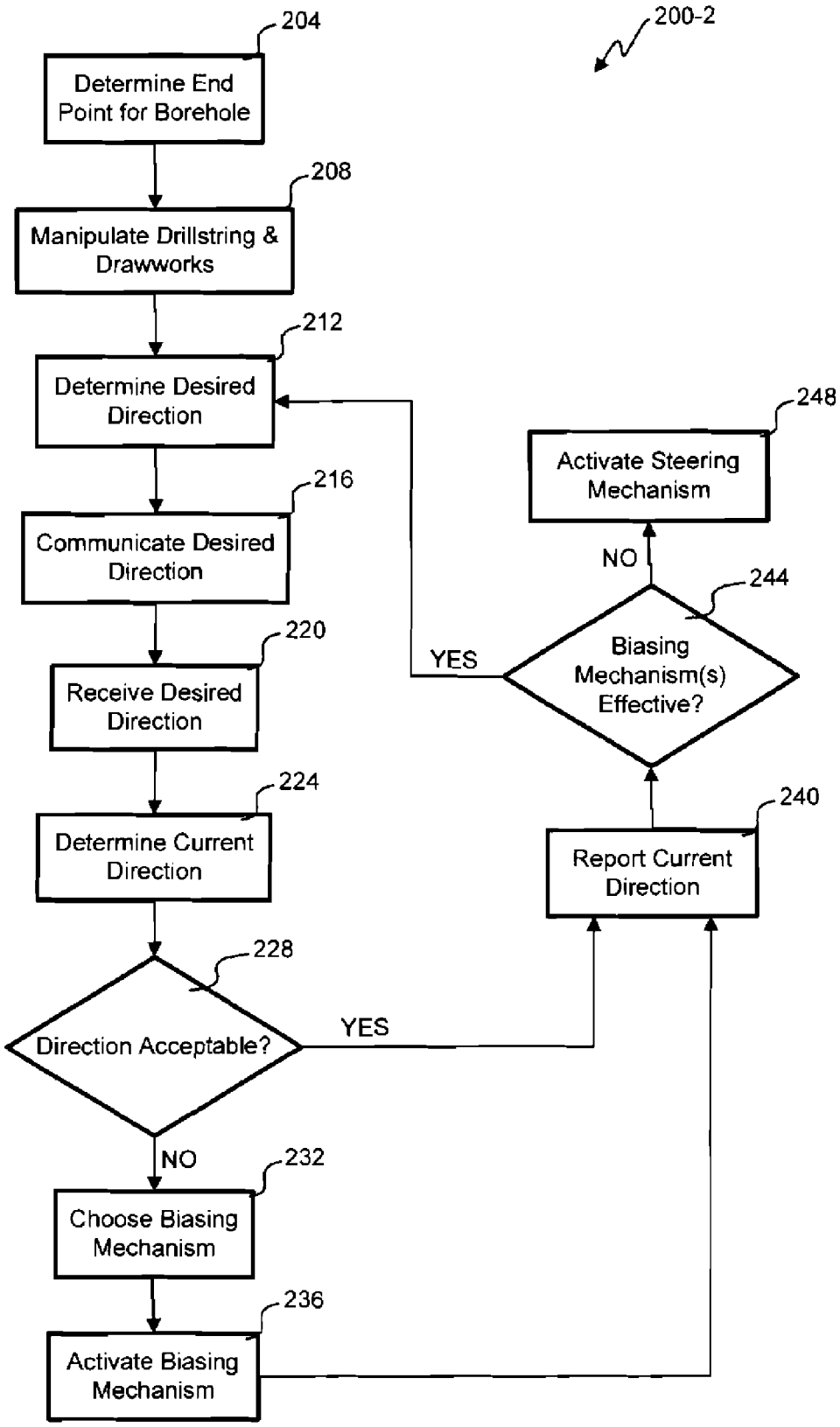

Referring next to FIG. 2B, a flowchart of another embodiment of the process 200-2 for controlling drill bit direction is shown. This embodiment has multiple biasing mechanisms 132 available and can fall back onto a steering mechanism 136 if the biasing mechanism(s) 132 is not effective. The blocks up to block 228 are generally performed the same as the embodiment in FIG. 2A. Where the direction is not acceptable in block 228, processing continues to block 232 where a selection is made from at least two biasing mechanisms 232. Guidance from the ICIS 104 may dictate or influence the decision on those biasing mechanisms 132 to select and in what manner they should be controlled. The selected biasing mechanism 132 is used in step 236.

After using the biasing mechanism 132, the current direction is reported to the ICIS 104 in block 240. If the biasing mechanism 132 or some other alternative is still believed to be effective in orienting the drill bit in block 244, processing loops back to block 212 to continue using that biasing mechanism 132 or some other biasing mechanism 132 that might influence those components of the radial motion of the drill bit to exert a side force in a particular azimuthal direction as desired. Where biasing mechanisms 132 are determined to be no longer effective in block 244, processing continues to block 248 to activate the steering mechanism 136, if any.

Figure 2C:
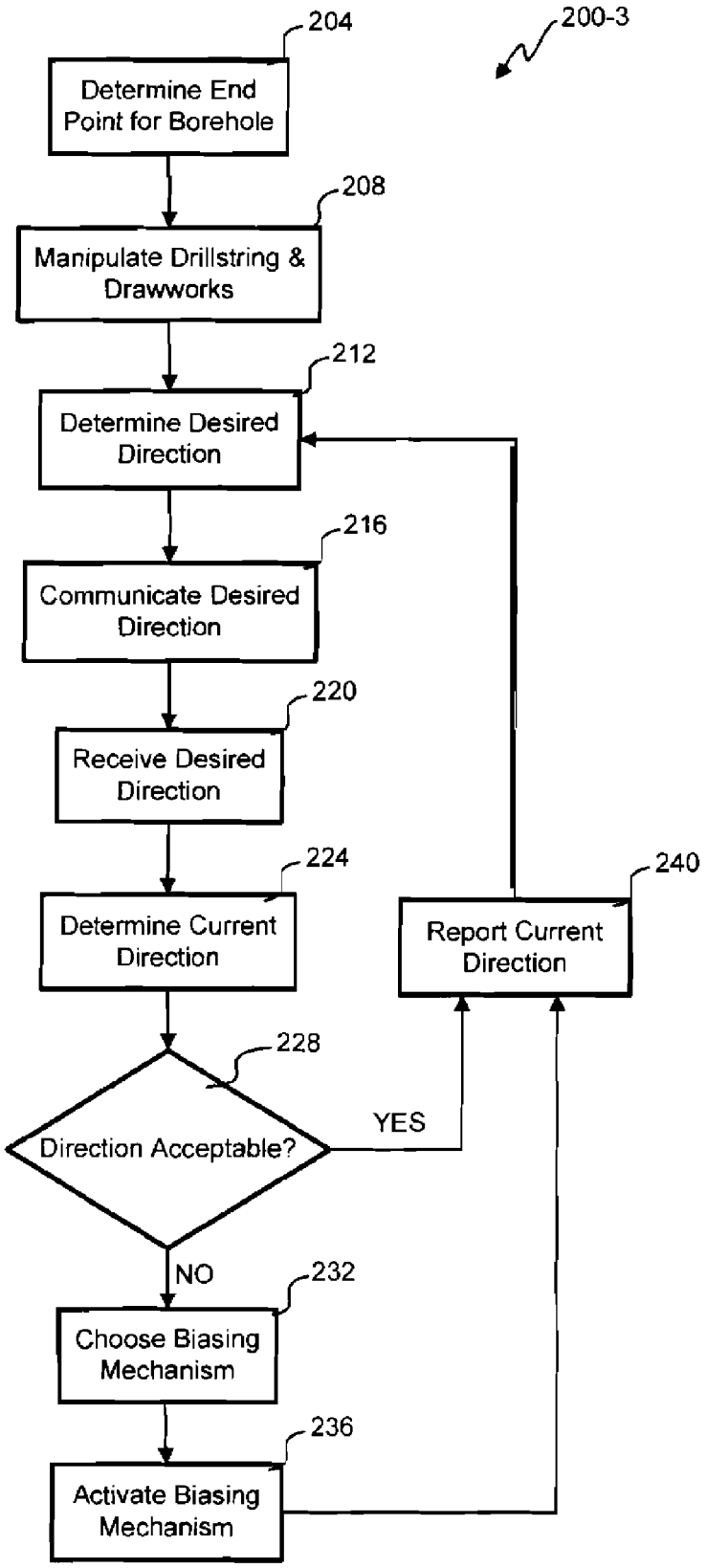

With reference to FIG. 2C, a flowchart of yet another embodiment of the process 200-3 for controlling drill bit direction is shown. This embodiment is similar to that of FIG. 2A except that multiple biasing mechanisms 132 can be chosen from in block 232. This embodiment only relies upon biasing mechanisms 132 without resort to steering mechanisms 136.

Figure 3A:
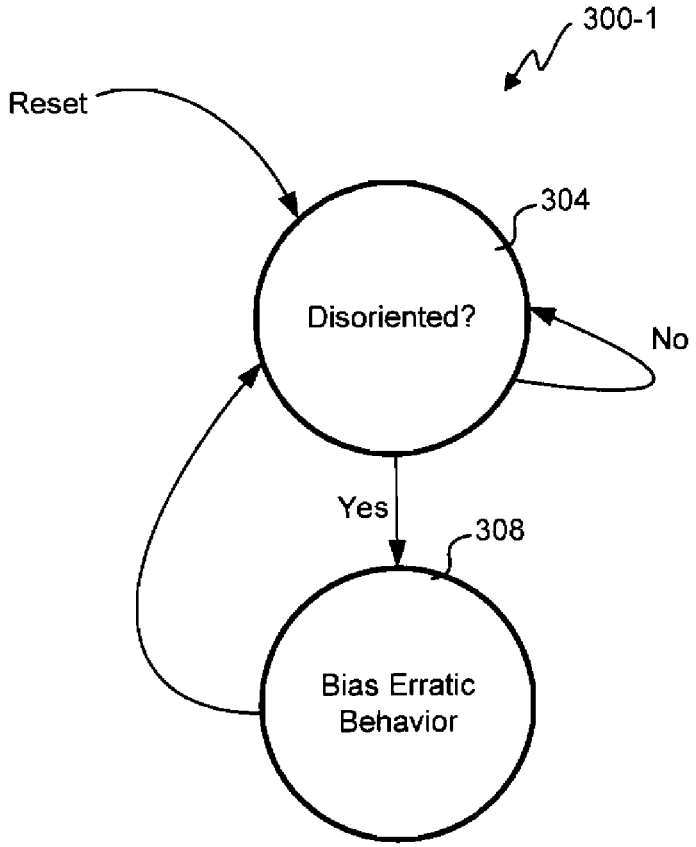
FIGS. 3A through 3C illustrate a state machine for managing the drill bit direction system.

Referring next to FIG. 3A, an embodiment of a state machine 300-1 for managing the drill bit direction system 100 is shown. This control system moves between two states based upon a determination in state 304 if the drill bit is not in alignment with a desired direction or range of directions. This embodiment corresponds to the embodiment of FIG. 2A. Where there is disorientation beyond an acceptable deviation, the drill bit direction system 100 goes from state 304 to state 308. In state 308, one or more of the biasing mechanisms are tried 132. In some cases, the same biasing mechanism 132 is tried with different parameters. For example, a gage pad can be moved at one phase in the bit rotation cycle, but later another phase is tried with the same or a different movement of the gage pad.

Figure 3B:
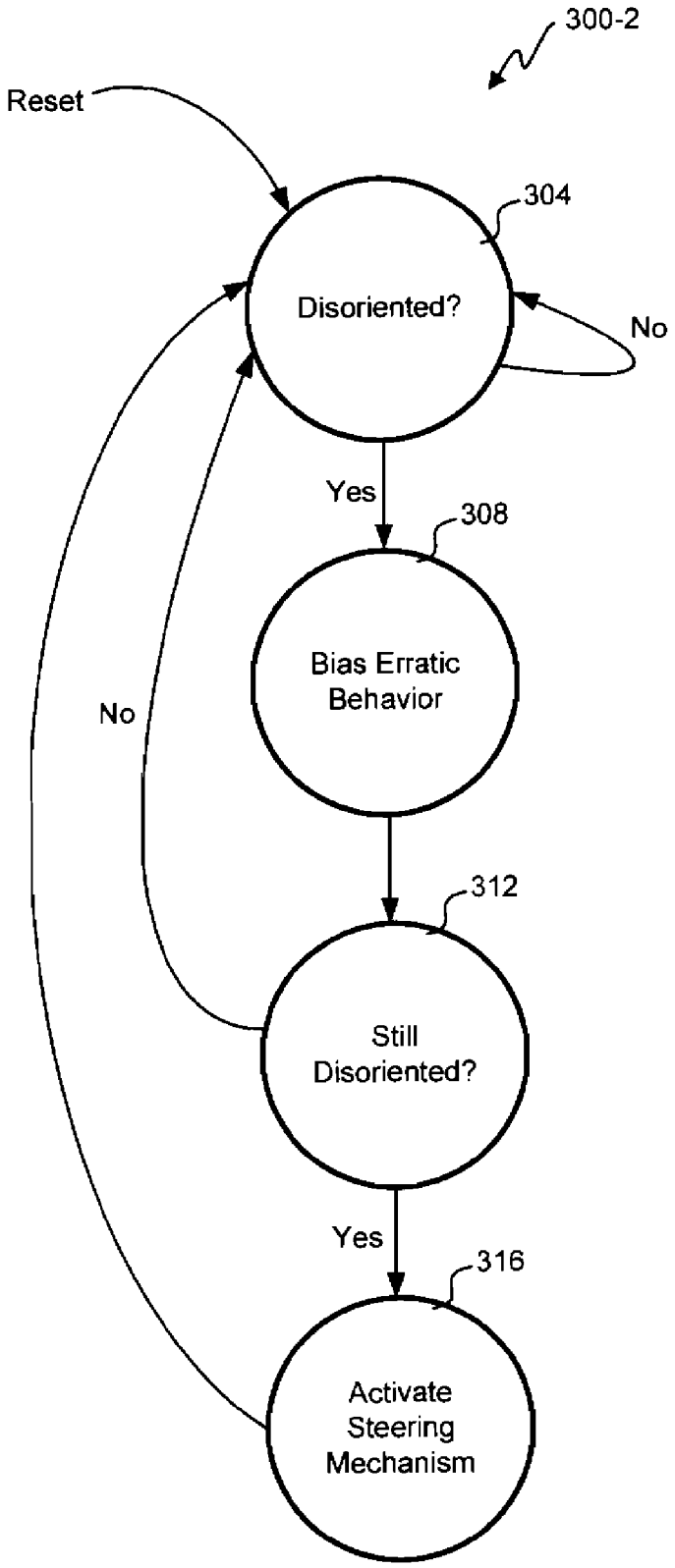

With reference to FIG. 3B, another embodiment of the state machine 300-2 for managing the drill bit direction system 100 is shown. This embodiment has four states and generally corresponds to the embodiment of FIG. 2B. After attempting a biasing mechanism 132 in state 308, a determination in state 312 is used to see if the biasing mechanism 132 was effective. Where the biasing mechanism 132 works adequately, the system returns to state 304. If the biasing mechanism 132 is not effective the drill bit direction system 100 goes from state 312 to state 316 where an active steering mechanism 136 is used before returning to state 304.

Figure 3C:
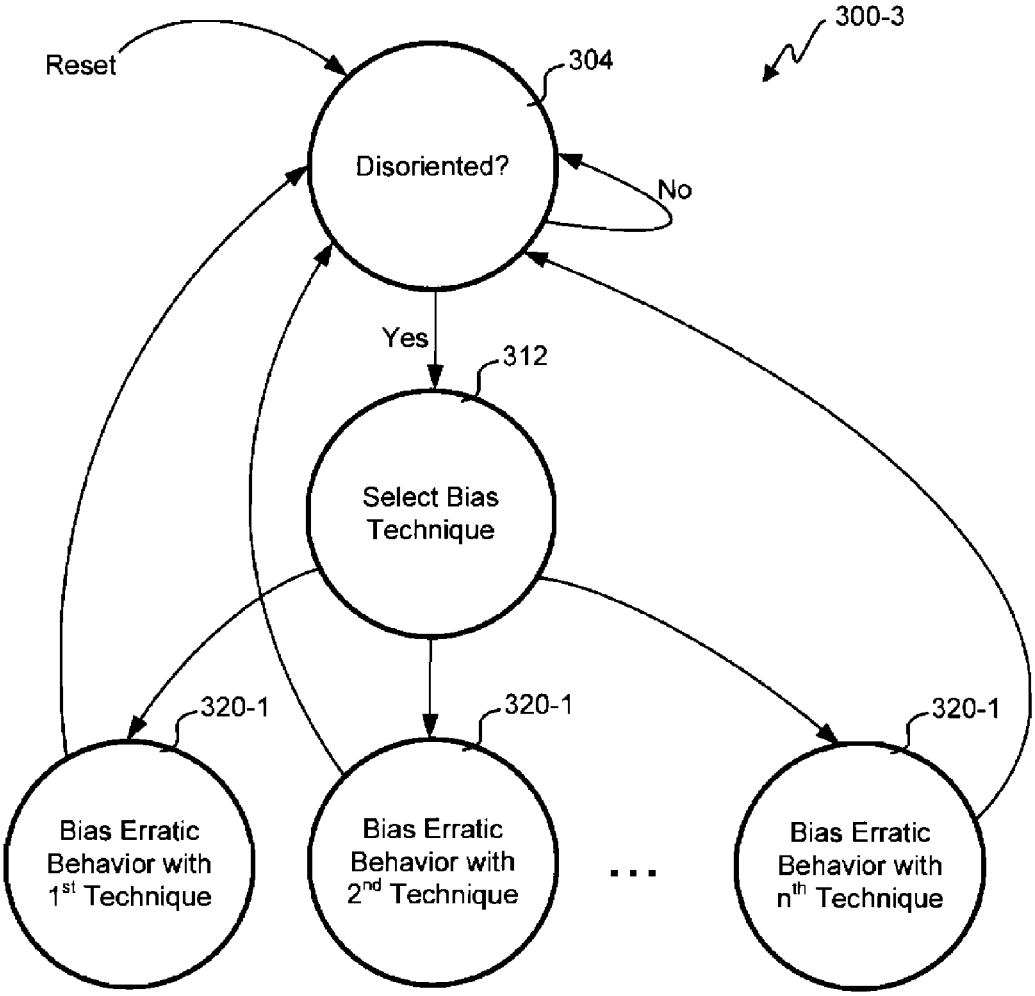

Referring next to FIG. 3C, yet another embodiment of the state machine 300-3 for managing the drill bit direction system 100 is shown. This embodiment has a number of biasing techniques and generally corresponds to the process 200-3 of FIG. 2C. Where disorientation is found in state 304, a biasing mechanism or technique is chosen in state 312. In the alternative, a number of biasing techniques can be chosen from state 312. The chosen biasing technique is performed in the chosen biasing state 320 before returning to state 304 for further analysis of any disorientation.

A number of variations and modifications of the disclosed embodiments can also be used. For example, the invention can be used on drilling boreholes or cores. The control of the biasing process is split between the ICIS and the BHA in the above embodiments. In other embodiments, all of the control can be in either location.

Specific details are given in the above description to provide a thorough understanding of the embodiments. However, it is understood that the embodiments may be practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Implementation of the techniques, blocks, steps and means described above may be done in various ways. For example, these techniques, blocks, steps and means may be implemented in hardware, software, or a combination thereof For a hardware implementation, the processing units may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described above, and/or a combination thereof Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Furthermore, embodiments may be implemented by hardware, software, scripting languages, firmware, middleware, microcode, hardware description languages, and/or any combination thereof When implemented in software, firmware, middleware, scripting language, and/or microcode, the program code or code segments to perform the necessary tasks may be stored in a machine readable medium such as a storage medium. A code segment or machine-executable instruction may represent a procedure, a function, a subprogram, a program, a routine, a subroutine, a module, a software package, a script, a class, or any combination of instructions, data structures, and/or program statements. A code segment may be coupled to another code segment or a hardware circuit by passing and/or receiving information, data, arguments, parameters, and/or memory contents. Information, arguments, parameters, data, etc. may be passed, forwarded, or transmitted via any suitable means including memory sharing, message passing, token passing, network transmission, etc.

For a firmware and/or software implementation, the methodologies may be implemented with modules (e.g., procedures, functions, and so on) that perform the functions described herein. Any machine-readable medium tangibly embodying instructions may be used in implementing the methodologies described herein. For example, software codes may be stored in a memory. Memory may be implemented within the processor or external to the processor. As used herein the term "memory" refers to any type of long term, short term, volatile, nonvolatile, or other storage medium and is not to be limited to any particular type of memory or number of memories, or type of media upon which memory is stored.

Moreover, as disclosed herein, the term "storage medium" may represent one or more memories for storing data, including read only memory (ROM), random access memory (RAM), magnetic RAM, core memory, magnetic disk storage mediums, optical storage mediums, flash memory devices and/or other machine readable mediums for storing information. The term "machine-readable medium" includes, but is not limited to portable or fixed storage devices, optical storage devices, wireless channels, and/or various other storage mediums capable of storing that contain or carry instruction (s) and/or data.

While the principles of the disclosure have been described above in connection with specific apparatuses and methods, it is to be clearly understood that this description is made only by way of example and not as limitation on the scope of the disclosure.

What is claimed is:

1. A method for biasing erratic motion of a bottomhole assembly of a drilling system, the bottomhole assembly including a drill bit, to provide for drilling a borehole in an earth formation in a predetermined direction relative to the earth, the method comprising steps of:

determining a direction relative to the earth in which the drilling system is tending to drill;

comparing the direction with the predetermined direction;

providing a biasing system that is configured to bias erratic motion of the downhole assembly in the borehole during drilling toward the predetermined direction, wherein the biasing system is coupled with the bottomhole assembly and held geostationary on the bottomhole assembly, and wherein the biasing system is configured to produce a circumferentially varying lateral compliance around the bottomhole assembly; and moving the biasing system on the bottomhole assembly to change the circumferentially varying lateral compliance when the comparing step determines the direction is not adequately aligned with the predetermined direction.

2. The method for biasing erratic motion of the drill bit to directionally cause the drill bit to drill in the predetermined direction relative to the earth as recited in claim 1, wherein:

the drill bit is manufactured to exert a rotating side force along some fixed direction relative to the drill bit, and the biasing system is configured to bias the rotating side force, whereby the drill bit tends to turn toward the predetermined direction.

3. The method for biasing erratic motion of the drill bit to directionally cause the drill bit to drill in the predetermined direction relative to the earth as recited in claim 1, further comprising a step of synchronizing the moving step with a phase of rotation of the drill bit.

4. The method for biasing erratic motion of the drill bit to directionally cause the drill bit to drill in the predetermined direction relative to the earth as recited in claim 1, further comprising a step of providing a steering mechanism that actively changes direction of the drill bit, wherein the steering mechanism is a point-the-bit mechanism.

5. The method for biasing erratic motion of the drill bit to directionally cause the drill bit to drill in the predetermined direction relative to the earth as recited in claim 1, further comprising a step of providing a steering mechanism that actively changes direction of the drill bit, wherein the steering mechanism is a push-the-bit mechanism.

6. The method for biasing erratic motion of the drill bit to directionally cause the drill bit to drill in the predetermined direction relative to the earth as recited in claim 1, further comprising a step of communicating the predetermined direction from above ground.

7. The method for biasing erratic motion of the drill bit to directionally cause the drill bit to drill in the predetermined direction relative to the earth as recited in claim 1, further comprising using a processor to process the predetermined direction.

8. The method for biasing erratic motion of the drill bit to directionally cause the drill bit to drill in the predetermined direction relative to the earth as recited in claim 7, wherein the processor is located in the borehole.

9. A drill bit direction system for biasing erratic motion of a drill bit or erratic reaction forces between the drill bit and an inner-wall of a borehole being drilled to directionally cause a drill bit to drill in a predetermined direction relative to the earth, the drill bit direction system comprising:

a bottomhole assembly, wherein the bottomhole assembly includes the drill bit;

a biasing system coupled with the bottomhole assembly and configured to produce a non-uniform lateral compliance around a circumference of a section of the bottomhole hole assembly, wherein the biasing system is coupled with the bottomhole assembly such that the non-uniform lateral compliance is held geostationary in the borehole;

a direction sensor to determine a drilling direction of the drill bit;

a controller for comparing a predetermined direction with the drilling direction, wherein the non-uniform lateral compliance produced by the biasing system is rotated around the bottomhole assembly when the drilling direction deviates from the predetermined direction or range of predetermined directions, and wherein the non-uniform lateral compliance produced by the biasing system is rotated around the bottomhole assembly to a position where the non-uniform lateral compliance produced by the biasing system biases the radial erratic motion towards the predetermined direction.

10. The drill bit direction system for biasing erratic motion of the drill bit to directionally cause the drill bit to drill in the predetermined direction relative to the earth as recited in claim 9, wherein:

the drill bit is manufactured to exert a rotating side force along some fixed direction relative to the drill bit, and the biasing system is configured to bias the rotating side force, whereby the drill bit tends to turn toward the predetermined direction.

11. The drill bit direction system for biasing erratic motion of the drill bit to directionally cause the drill bit to drill in the predetermined direction relative to the earth as recited in claim 10, wherein the controller is located downhole.

12. The drill bit direction system for biasing erratic motion of the drill bit to directionally cause the drill bit to drill in the predetermined direction relative to the earth as recited in claim 10, wherein the predetermined direction is determined on a surface and communicated to the bottomhole assembly.

13. The drill bit direction system for biasing erratic motion of the drill bit to directionally cause the drill bit to drill in the predetermined direction relative to the earth as recited in claim 10, further comprising a bit rotation sensor, wherein the biasing system is synchronized with rotation of the drill bit.

14. The drill bit direction system for biasing erratic motion of the drill bit to directionally cause the drill bit to drill in the predetermined direction relative to the earth as recited in claim 10, wherein the biasing system comprises a collar coupled with the bottomhole assembly by one or more compliant pads, and wherein the one or more compliant pads produce the non-uniform lateral compliance.

15. The drill bit direction system for biasing erratic motion of the drill bit to directionally cause the drill bit to drill in the predetermined direction relative to the earth as recited in claim 10, wherein the biasing system comprises a collar coupled with the bottomhole assembly and configured such that at least a section of the collar is capable of moving laterally on the bottomhole assembly to produce the non-uniform lateral compliance.

16. The drill bit direction system for biasing erratic motion of the drill bit to directionally cause the drill bit to drill in the predetermined direction relative to the earth as recited in claim 10, wherein the lateral compliance comprises a compliance in a direction of a longitudinal axis of the bottomhole assembly.

17. The drill bit direction system for biasing erratic motion of the drill bit to directionally cause the drill bit to drill in the predetermined direction relative to the earth as recited in claim 10, wherein the drill bit comprises gauge cutters.

* * * * *